US009655802B2

(12) United States Patent
Cammisa

(10) Patent No.: US 9,655,802 B2
(45) Date of Patent: May 23, 2017

(54) UPPER BODY ATTACHMENT APPARATUS FOR WHOLE BODY VIBRATION EQUIPMENT

(71) Applicant: Perry A. Cammisa, Woodridge, IL (US)

(72) Inventor: Perry A. Cammisa, Woodridge, IL (US)

( * ) Notice: Subject to any disclaimer, the term of this patent is extended or adjusted under 35 U.S.C. 154(b) by 844 days.

(21) Appl. No.: 13/659,513

(22) Filed: Oct. 24, 2012

(65) Prior Publication Data

US 2013/0110016 A1 May 2, 2013

Related U.S. Application Data

(60) Provisional application No. 61/551,696, filed on Oct. 26, 2011, provisional application No. 61/660,368, filed on Jun. 15, 2012.

(51) Int. Cl.
*A61H 1/00* (2006.01)
*A61H 23/00* (2006.01)

(52) U.S. Cl.
CPC ..... *A61H 1/005* (2013.01); *A61H 1/001* (2013.01); *A61H 23/00* (2013.01);
(Continued)

(58) Field of Classification Search
CPC ..... A61H 1/00; A61H 1/001; A61H 1/003; A61H 1/005; A61H 23/00;
(Continued)

(56) References Cited

U.S. PATENT DOCUMENTS 2,246,689 A * 6/1941 Kost ..... A61H 1/0266 474/26
2,349,743 A * 5/1944 Meyer ..... 601/49
(Continued)

FOREIGN PATENT DOCUMENTS

WO 2006070429 A1 7/2006
WO WO 2006070429 A1 * 7/2006

OTHER PUBLICATIONS

Versa ExerVibe Climber, pp. 1-4, Using Whole Body Vibration Technology.

(Continued)

*Primary Examiner* — Justine Vu
*Assistant Examiner* — Tu Vo
(74) *Attorney, Agent, or Firm* — Patzik, Frank & Samotny Ltd.

(57) ABSTRACT

An upper body attachment, which may be used with a piece of exercising, stretching, or massaging equipment that incorporates whole body vibration (WBV) technology, provides a user with a way to apply WBV technology to the upper body. The attachment may include a pair of uprights and a crossbar to which a variety of types of handles may be slidably attached. The attachment may have a base that both supports the uprights and connects the uprights with the equipment incorporating the WBV technology. Accordingly, the attachment transfers vibrations from the vibrating equipment to the handles that a user grips. Several exemplary WBV upper body exercises that the attachment facilitates include push-ups, pull-ups, and dips.

20 Claims, 5 Drawing Sheets

(52) U.S. Cl.
CPC ..... *A61H 2201/0107* (2013.01); *A61H 2201/1623* (2013.01); *A61H 2201/1635* (2013.01); *A61H 2203/0406* (2013.01)

(58) Field of Classification Search
CPC ..... A61H 2023/002; A61H 23/006; A61H 23/02; A61H 2201/12; A61H 2201/1207; A61H 2201/1623; A61H 2201/1635; A61H 2201/0107
See application file for complete search history.

(56) References Cited

U.S. PATENT DOCUMENTS

| | | | | |
|---|---|---|---|---|
| 2,719,568 | A | 10/1955 | Webb | |
| 3,077,869 | A * | 2/1963 | Von Olnhausen | A61H 1/005 601/49 |
| 3,568,226 | A | 3/1971 | Mater et al. | |
| 3,707,285 | A * | 12/1972 | Martin | 482/38 |
| 3,778,052 | A | 12/1973 | Andow et al. | |
| 5,609,566 | A * | 3/1997 | Pupovic | 601/23 |
| 5,633,467 | A | 5/1997 | Paulson | |
| 5,716,331 | A * | 2/1998 | Chang | A61H 1/005 601/28 |
| 5,813,951 | A | 9/1998 | Einsig | |
| 5,921,899 | A * | 7/1999 | Rose | A63B 5/11 482/112 |
| 6,620,117 | B1 * | 9/2003 | Johnson | A61H 1/005 601/84 |
| 7,166,067 | B2 | 1/2007 | Talish et al. | |
| 7,278,977 | B1 * | 10/2007 | Chen | A61H 1/003 601/30 |
| 7,322,948 | B2 | 1/2008 | Talish et al. | |
| D586,468 | S | 2/2009 | Petersen | |
| 7,563,235 | B2 | 7/2009 | van der Meer | |
| 7,594,878 | B1 | 9/2009 | Joannou | |
| 7,753,825 | B2 | 7/2010 | Jaquish et al. | |
| 7,775,937 | B2 | 8/2010 | Jaquish et al. | |
| 7,780,574 | B2 | 8/2010 | Jaquish et al. | |
| 7,806,806 | B2 | 10/2010 | Jaquish et al. | |
| 7,909,747 | B1 * | 3/2011 | LaCaze | A63B 21/00196 482/142 |
| D640,334 | S | 6/2011 | Aboody | |
| 7,959,540 | B2 | 6/2011 | Jaquish et al. | |
| 2004/0067833 | A1 * | 4/2004 | Talish et al. | 482/148 |
| 2004/0110612 | A1 * | 6/2004 | Read | 482/142 |
| 2005/0165332 | A1 | 7/2005 | Talish et al. | |
| 2006/0200054 | A1 * | 9/2006 | Talish | A61H 1/005 601/98 |
| 2007/0213179 | A1 * | 9/2007 | Trandafir | A61H 1/005 482/51 |
| 2007/0219052 | A1 | 9/2007 | Schuurman et al. | |
| 2007/0265147 | A1 * | 11/2007 | Shingary | 482/98 |
| 2007/0290632 | A1 | 12/2007 | Stevens | |
| 2008/0207407 | A1 * | 8/2008 | Yeh | 482/54 |
| 2009/0221405 | A1 * | 9/2009 | Wang | 482/54 |
| 2011/0015042 | A1 | 1/2011 | Jaquish et al. | |
| 2011/0028280 | A1 * | 2/2011 | Adams | 482/94 |
| 2011/0230803 | A1 | 9/2011 | Aboody | |

OTHER PUBLICATIONS

VibraSlim; MyVibraSlim.com; pp. 1-3; Website: http://www.myvibraslim.com/vibration_machines_htm; dated Oct. 11, 2011.
Teutonic iShape ; Teutonic Products—Vibration Technology; pp. 1-2; Website: http://www.teutonicsales.com/ishape.php; dated Oct. 11, 2011.
European Patent Search Report; dated Aug. 8, 2015; Application No./Patent No. 12843374.5-1658 / 2768462 PCT/US2012061903; 9 pages.
PCT Notification of Transmittal of International Search Report and the Written Opinion of the International Searching Authority, or the Declaration; dated Jan. 24, 2013; International Application No. PCT/US12/61903; Applicant: Cammisa, Perry A.
Republic of China Intellectual Property First Office Action; dated Oct. 10, 2015; Application No. 201280064312.8; 17 pages; English and Chinese Language Versions.
Republic of China Intellectual Property Second Office Action; dated Aug. 22, 2016; Application No. 201280064312.8; 10 pages; English and Chinese Language Versions.

* cited by examiner

UPPER BODY ATTACHMENT APPARATUS FOR WHOLE BODY VIBRATION EQUIPMENT

PRIORITY STATEMENT

This application claims the benefit of U.S. Provisional Application No. 61/551,696, filed Oct. 26, 2011 and U.S. Provisional Application No. 61/660,368, filed Jun. 15, 2012.

FIELD OF THE INVENTION

The present disclosure relates generally to the field of whole body vibration exercise equipment. In particular, the present disclosure relates to an attachment for whole body vibration exercise equipment that allows for the transfer of vibration to and through the attachment and targets and provides directed, specific, targeted vibration to muscle groups involving the torso, upper or lower extremities or the upper and lower body as distinct regions depending upon the desired focus of the therapist or end user.

BACKGROUND OF THE INVENTION

In recent years, exercise equipment manufacturers have introduced machines having whole body vibration (WBV) technology. The idea behind WBV technology is to impart vibrations to the human body, oftentimes as an individual is exercising, stretching, or being massaged. The frequency of WBV technology ranges to some degree, but manufacturers typically utilize frequencies between 20 and 70 hertz (Hz). The benefits of using WBV technology have been shown to include improved muscle tissue, arthritis relief, hormone stimulation, improved blood flow, improved bone density, and general rehabilitative therapy for joints, ligaments, tendons, and the like. However, it is believed that still more benefits have yet to be recognized.

In the brief history of WBV exercise machine technology, manufacturers have designed WBV machines that provide a vibrating platform on which users sit or stand while exercising or stretching. These WBV machines typically provide a handrail similar to those seen on an elliptical machine or a treadmill. These handrails, though, do not vibrate and are not intended to provide WBV. Rather, these handrails are intended to serve as a means for stabilizing the user while exercising, stretching, standing, etc. As a result, the effects of the vibration are substantially limited to the user's feet, or legs at best. Thus, existing WBV machines do not necessarily provide "whole" body vibration, but merely provide general, unfocused vibration from only the platform of the device.

One more-recent piece of exercise equipment that attempts to implement WBV technology is a climbing machine. The climbing machine provides two steps for a user's feet and two handles for a user's hands. In one mode, the user may perform a basic climbing motion by sliding his or her left and right extremities up and down (perhaps in a somewhat circular motion) on an alternating basis. Regardless of which mode is used, the climbing machine can vibrate the steps, handles, or steps and handles as a user stands on the ground or the steps. In the alternative, the user may sit on a vibrating seat.

One of the disadvantages with the climbing machine, though, like other WBV machines, is that the climbing machine cannot offer the user a WBV experience that targets the upper body. Although the handles of the climbing machine may vibrate, the user's weight is still supported by his or her legs, whether standing on the ground, standing on the steps, or sitting on a chair. Thus, in contrast to the experience a vibrating foot plate provides to a user's lower torso, no meaningful vibrations are imparted from the handles of the climbing machine to the user's upper torso.

Therefore, it is desirable to have exercise equipment that offers a user a WBV experience that can target the lower and upper body either together or separately and provide a meaningful WBV experience. The present invention solves this and other disadvantages of the prior art.

SUMMARY OF THE INVENTION

It is an object of the present invention to provide an attachment for whole body vibration (WBV) exercising, stretching, or massaging equipment wherein the attachment can transfer vibrations from the equipment to handles that are appropriately shaped and positioned for upper body exercise, stretching, or massage. In effect, the attachment imparts the vibrations of the WBV equipment to the body of users in a targeted and specific manner for maximum stimulation of the tissues directly associated with the attachment.

While many possible design configurations exist, the attachment may in one embodiment include one or more of a base, a pair of uprights, a crossbar, lower handles, and an upper handlebar. The base of the attachment may be generally rectangular shaped, with fastener plates or other points of attachment extending from the base. In the alternative, the points of attachment may extend directly through members of the base. Further, the pair of uprights may extend generally upward from the base, supported by diagonal support members. The pair of uprights may be spaced apart enough such that a user of the equipment and attachment could fit and move comfortably between the uprights. The crossbar, moreover, may be secured to top ends of the uprights, providing rigidity to the uprights.

Various types of handles may be slidably attached to the crossbar or to the uprights. The handles may be slidably attached so that a user can adjust the height of the handles depending on the desired exercise and/or the user's physique. One exemplary handle is the upper handlebar, which may extend generally between the pair of uprights. The upper handlebar is positionable above the head of the user and may be ideal for pull-ups and rehabilitative shoulder therapy, for example. The lower handles may allow the user to perform different exercises targeting the upper body, such as dips, for example, which target triceps brachii muscles.

Further, the attachment for WBV exercising, stretching, or massaging equipment can include interchangeable handles, bars, pads, supports, fulcrums, and other devices that can be attached to the attachment support frame, which is attached to the WBV exercise machine to achieve specific desired training objectives. These interchangeable devices are specifically used to assist in normalizing or improving exercising, stretching, or massaging capabilities, for example, abnormal biomechanics and postural alterations of the human skeleton, such as both extremities and the spine. Specific positioning of these various interchangeable devices will allow the user to perform isometric exercises under load while simultaneously under the effects of the WBV exercise machine. Specific attachments can also be used to address spinal instabilities and weaknesses by targeting specific musculature or joint complexes.

Additionally, various devices, such as weights or other forms of resistance, can be connected to the attachment support frame to be used in conjunction with the WBV exercise machine. As an example, this configuration will allow a physician or a therapist to assist a patient or user to create specific forces that affect targeted spinal structures. These structures can include ligaments, tendons, muscles, discs, and other structures affected by abnormal biomechanics.

In one embodiment, the attachment may also include an upper diagonal support that attaches the crossbar to a stabilization handrail of the WBV exercise machine. Notably, the upper diagonal support may prevent the upper portion of the attachment from swaying while also allowing the upper portion of the attachment to vibrate as intended. To allow for such a limited range of motion, the upper diagonal support may be attached to the crossbar and the stabilization handrail with rubber bushings. The rubber bushings may help prevent the upper diagonal support from damping intended vibrations in the upper portion of the attachment, but may also prevent the upper portion of the attachment from swaying.

It is another object of the present invention to provide a piece of WBV exercising, stretching, and/or massaging equipment that imparts vibrations in handles that are appropriately-shaped and positioned for exercising, stretching, and/or massaging the upper body. Thus, the present disclosure is applicable to more than after-market applications.

The foregoing and other aspects, features, details, utilities, and advantages of the present teachings will become apparent from reading the following description and claims, and from reviewing the accompanying drawings.

BRIEF DESCRIPTION OF THE DRAWINGS

Aspects, features, details, utilities, and advantages of the present invention will be apparent from reading the following description and from reviewing the accompanying drawings and photographs, where.

DETAILED DESCRIPTION OF EMBODIMENTS OF THE INVENTION

The present disclosure concerns an attachment for whole body vibration (WBV) exercise equipment. The attachment is intended to utilize WBV technology to enable users of the equipment to exercise, stretch, or massage their upper bodies. The present disclosure also contemplates embodiments wherein the attachment is integral with and/or original to the exercise equipment as initially sold by a manufacturer. In other words, the disclosed attachment is not limited to use solely as an accessory or an after-market product.

Figure 1A:
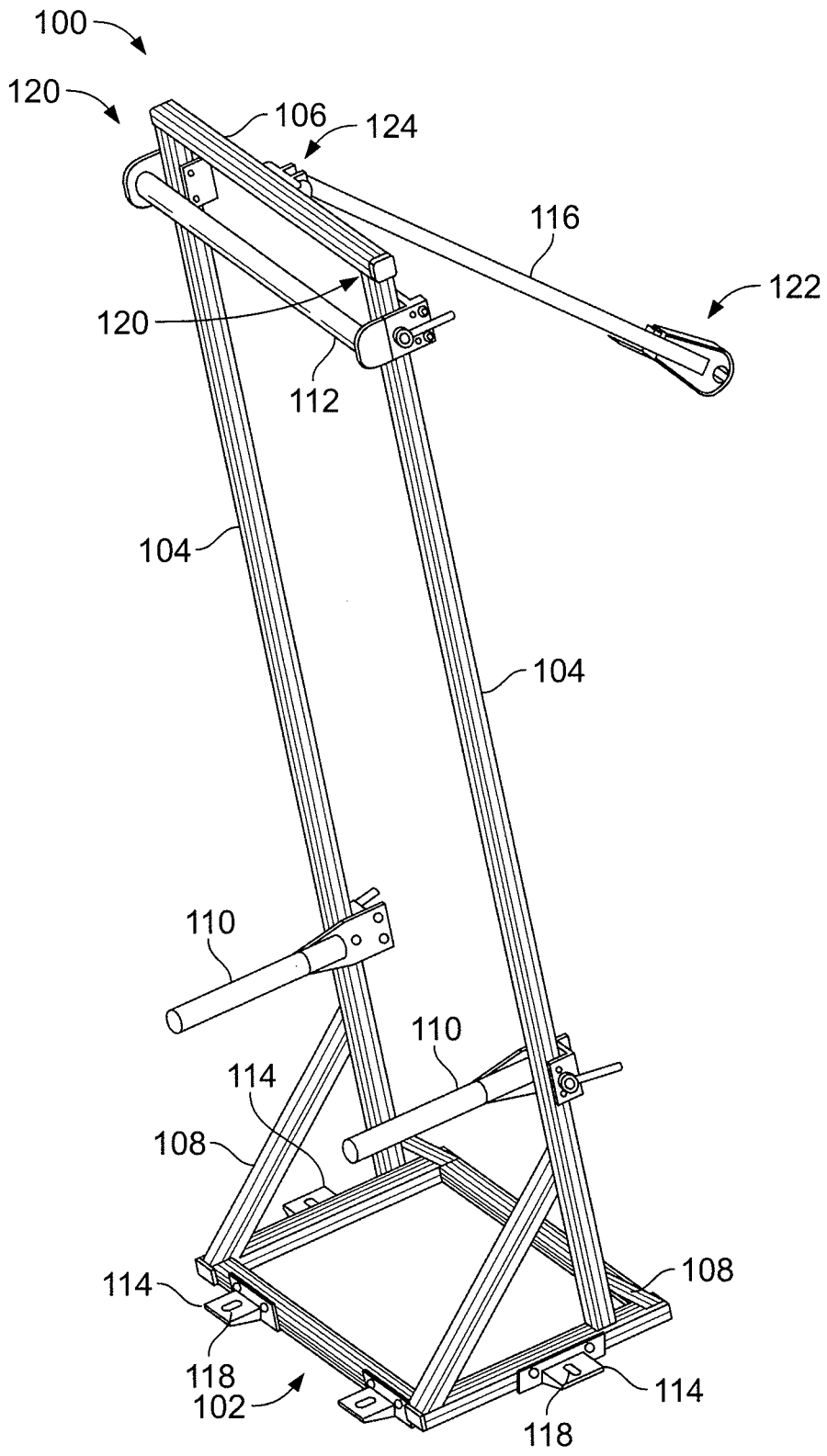
FIG. 1A is a perspective view of an upper body attachment for whole body vibration apparatuses.
Figure 1D:
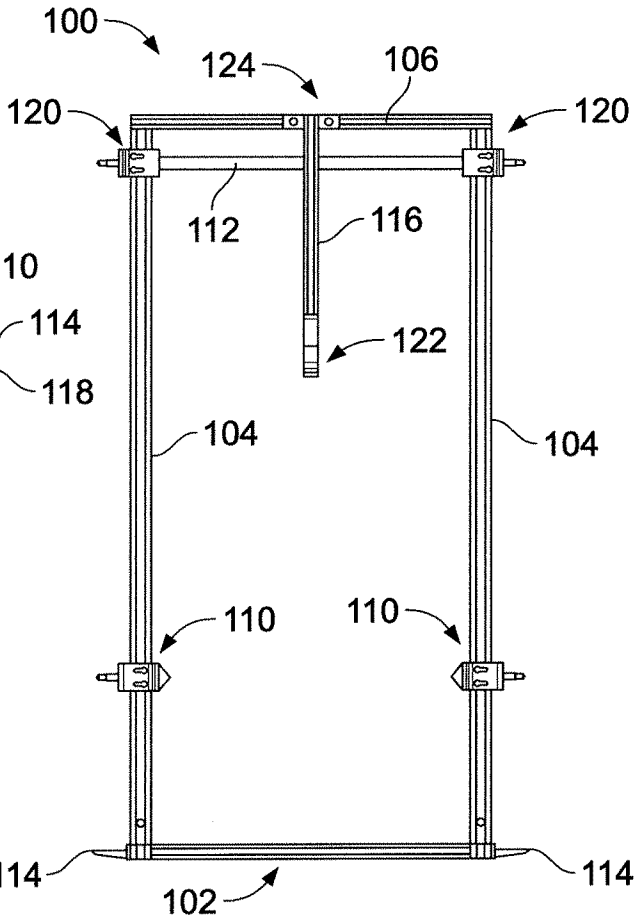
FIG. 1D is a back view of the upper body attachment of FIGS. 1A-1C.
Figure 1C:
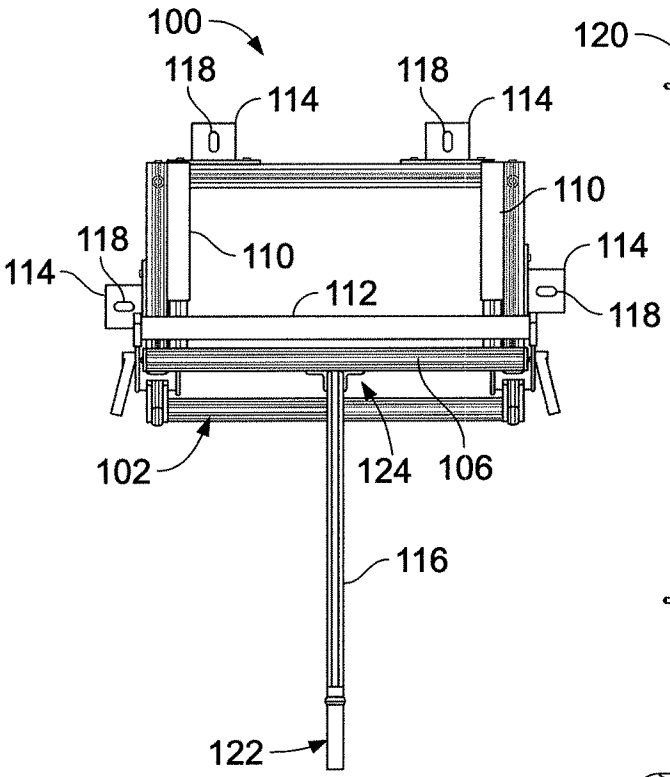
FIG. 1C is a top view of the upper body attachment of FIGS. 1A-1B.
Figure 1B:
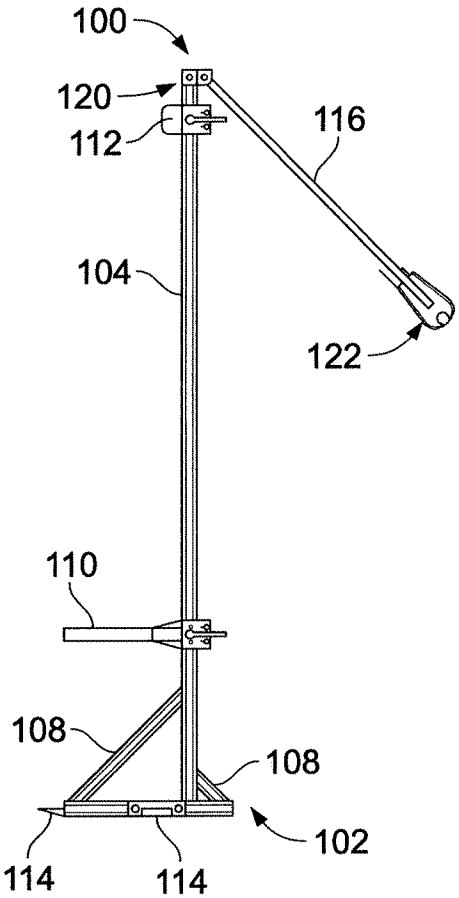
FIG. 1B is a side view of the upper body attachment of FIG. 1A.

FIGS. 1A, 1B, 1C, and 1D, which are not drawn to scale, show numerous views of an attachment 100 for exercise equipment utilizing WBV technology. Specifically, FIG. 1A provides a perspective view of the attachment 100, FIG. 1B provides a side view of the attachment 100, FIG. 1C provides a top view of the attachment 100, and FIG. 1D provides a back view of the attachment 100.

With reference to FIGS. 1A-1D, the attachment 100 may be formed from a number of structural supports and handles. In particular, one embodiment of the attachment 100 may generally include a base 102, uprights 104, a crossbar 106, lower diagonal supports 108, lower handles 110, an upper handlebar 112, points of attachment 114, and an upper diagonal support 116. The disclosed attachment 100 is not limited to the specific embodiments described and shown herein.

Considering the uprights 104, for example: the uprights 104 need not necessarily be generally orthogonal to the base 102; the uprights 104 need not necessarily be generally straight; or a single structure or more than two structures may act as the uprights 104. In short, the present disclosure contemplates forming the attachment 100 in a multitude of different ways.

In one embodiment, the base 102 may take on a generally rectangular shape. Because the base 102 may be attached to a piece of WBV exercise equipment (example shown in FIG. 4), as described below, the points of attachment 114 may affix to the base 102. In the alternative, the base 102 itself could include the points of attachment 114. For example, apertures could be formed in the members of the base 102 such that fasteners could extend through the base 102 and into the WBV exercise equipment, or vise versa.

As shown in FIGS. 1A-1D, however, the points of attachment 114 may have apertures 118 for receiving fasteners (not shown) to couple or affix the base 102 of the attachment 100 to the piece of WBV exercise equipment. In some embodiments, the base 102 may lay flush against the piece of WBV exercise equipment. In other embodiments, the base 102 may contact the piece of WBV exercise equipment only at or near the points of attachment 114.

The uprights 104 may extend generally upward from the base 102. In some embodiments, the uprights 104 may be fastened generally orthogonal to the base 102. In other embodiments, the uprights 104 may be welded generally orthogonal to the base 102. In still other embodiments, the uprights 104 may not necessarily be generally orthogonal to the base 102. Nonetheless, the uprights 104 may be supported by one or more lower diagonal supports 108 also extending from the base 102. The lower diagonal supports 108 may likewise be fastened or welded to the base 102 and are intended to support the uprights 104 and, in general, the vertically-extending portion of the attachment 100. Further, ends 120 of the uprights 104 may be attached to the crossbar 106 of the attachment 100. The crossbar 106 may also be fastened or welded to the ends 120 of the uprights 104. Regardless of the mode of fastening the attachment 100 of the present disclosure to the WBV exercise equipment, the purpose is to transfer the vibration from the WBV exercise equipment to and through the attachment 100.

Although the upper diagonal support 116 of the attachment 100 is described further below, the upper diagonal support 116 may provide a further point of attachment 122 to the WBV exercise equipment and an adjustment feature (not shown) for providing further compatibility with a variety of WBV exercise machines. The upper diagonal support 116 may be attached to the crossbar 106 at roughly a mid-point 124 of the crossbar 106 between the ends 120 of the uprights 104.

The materials used for members of the attachment 100 may be any metal (e.g., aluminum) or metal alloy. However, several design factors are worth considering when selecting materials. For one, the material(s) selected for the members of the attachment 100 should be capable of efficiently transferring vibrations from the WBV exercise machine, which may be positioned at or near the base 102 of the attachment 100, to the top of the attachment 100 near the crossbar 106 and ends 120 of the uprights 104. Second, the material(s) selected should not be too heavy so as to strain or overburden the motor(s) of the WBV exercise equipment. One exemplary material that meets these design criteria is 80/20 aluminum.

As described above, the attachment 100 provides a variety of ways in which a user may stretch, exercise, or massage or otherwise stimulate for specific effect, portions of the upper body while points of contact, i.e., where the user grips the WBV machine and/or the attachment 100) vibrate, unlike traditional WBV exercise equipment. Further, the attachment 100 may provide stimulation of microcirculation and macrocirculation, as well as improved lymphatic drainage.

In particular, the attachment 100 allows for a number of weight-bearing and/or weight-suspending exercises that are not possible with traditional WBV exercise equipment. The adjustability of the lower handles 110 and the upper handlebar 112, as described below with reference to FIGS. 2 and 3, further extends these possibilities.

The lower handles 110 allow a user to perform the "dips" exercise. As the user bears his or her body weight through his or her aims and onto the lower handles 110, the base 102 attached to a WBV exercise machine transfers vibrations up through the uprights 104, into the lower handles 110, and thus into an upper body of the user.

Another exemplary exercise that the user can perform via the lower handles 110 is push-ups. If the user elevates his or her feet on an object, such as a chair or bed, for example, and grips the lower handles 110 in his or her hands, the user may perform push-ups as vibrations are imparted through the user's upper body. With this exercise, the user can control the amount of weight that is placed onto the lower handles 110 by further elevating or lowering the height where his or her feet or positioned. This in turn allows the user to control the amount of vibration that is experienced in his or her upper body.

Still another exercise, namely, "leg lifts," can be performed if the lower handles 110 are modified with some cushioning and formed in an "L" shape. One way to modify the lower handle 110 for this capability—while maintaining the functionality of the lower handle 110 as shown in FIGS. 1A-1D—is to place padding and an "L" extension on the lower side of the lower handles 110. When the user wishes to perform leg lifts, the user may unclip the lower handles 110, turn them upside down, and attach each to the opposite upright 104. As such, the cushioning and "L" extension faces upwards.

Moreover, the upper handlebar 112 may be lowered, and an optional backrest may be attached thereto. Then, the user may place the underside of his or her forearms on the cushioning while gripping the "L" extension of the lower handles 110 and resting his or her back against the backrest attached to the upper handlebar 112. As vibrations are imparted from the lower handles 110 to the user's arms, shoulders, and upper torso, the user may perform leg lifts, which further exercise the abdomen.

The present disclosure contemplates still other exercises with the lower handles 110, especially if the lower handles 110 are modified to hold weights. In such an embodiment, the attachment 100 would enable a user to perform dead lifts, shoulder shrugs, and countless other weight-bearing exercises that incorporate WBV.

With regard to the upper handlebar 106, when positioned near the crossbar 106 as shown in FIGS. 1A, 1B, and 1D, the upper handlebar 106 may likewise impart vibrations upon a user's upper body. The primary difference here is that the user is either suspending his or her weight from, or at least reaching upwards to grip, the upper handlebar 106. As mere examples of the utility of the upper handlebar 106, the user may perform pull-ups and shoulder rehabilitation exercises. The user could even lower the upper handlebar 106 enough to use it to perform push-ups, similar to how the lower handles 110 are used for performing push-ups.

Figure 2:
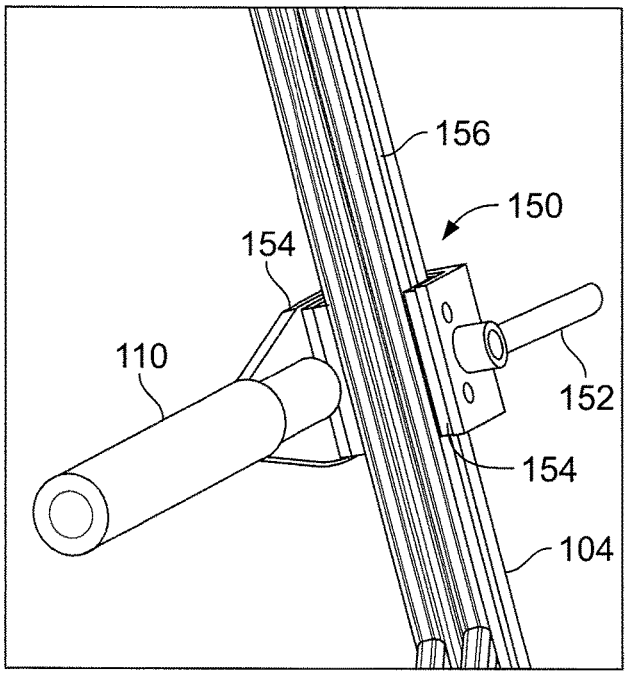
FIG. 2 is a perspective view of a lower handle that is slidable along a vertical member of the upper body attachment of FIGS. 1A-1D.
Figure 3:
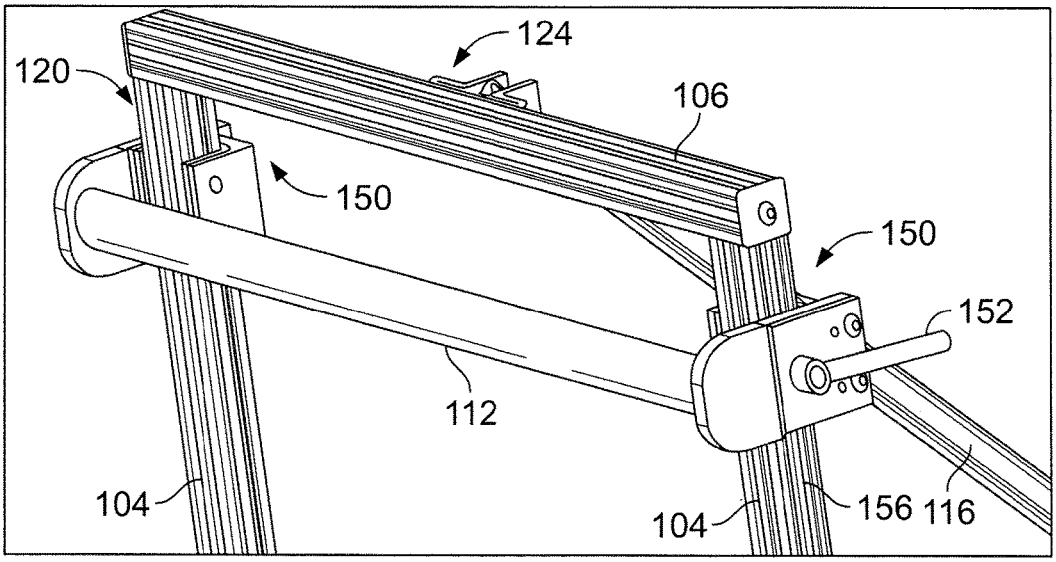
FIG. 3 is a perspective view of an upper handle that is slidable along vertical members of the upper body attachment of FIGS. 1A-1D.

Now referring to FIG. 2, the lower handles 110 may be slidably fastened to the uprights 104 such that users of the attachment can adjust the height of the lower handles 110 depending on the desired exercise and the user's physique. The manner in which the lower handle 110 is attached to the upright 104 is not critical. In FIG. 2, for example, a clamp 150 fastens the lower handle 110 to the upright 104. A rotatable fastener 152 allows the user to tighten and loosen the clamp 150 having slightly deformable internal layers 154 about the upright 104. Further, the slightly deformable internal layers 154 may have a protrusion (not shown) that is received by a slotted track 156 in the upright 104. The slotted tracks 156 allow the clamps 150 to slide up and down the uprights 104 when the clamps are loosened. Similar clamps 150 are shown in FIG. 3, except that these clamps 150 slidably fasten the upper handlebar 112 to the uprights 104.

As described above, interchangeable handles, bars, pads, supports, fulcrums, and other devices can be connected or joined to the attachment to achieve specific training objectives. These interchangeable devices can be specifically used to assist in normalizing or improving exercising, stretching, or massaging capabilities, for example, abnormal biomechanics and postural alterations of the human skeleton, such as both extremities and the spine. Specific positioning of these various interchangeable devices will allow the user to perform isometric exercises under load while simultaneously under the effects of the vibrations from the WBV machine. Specific attachments can also be used to address spinal instabilities and weaknesses by targeting specific musculature or joint complexes.

Further, devices, such as weights or other forms of resistance, can be connected to the attachment support frame to be used in conjunction with the WBV machine. As an example, this configuration will allow a physician or a therapist to assist a patient or user to create specific forces that affect targeted spinal structures, including ligaments, tendons, muscles, discs, and other structures affected by abnormal biomechanics.

Figure 4:
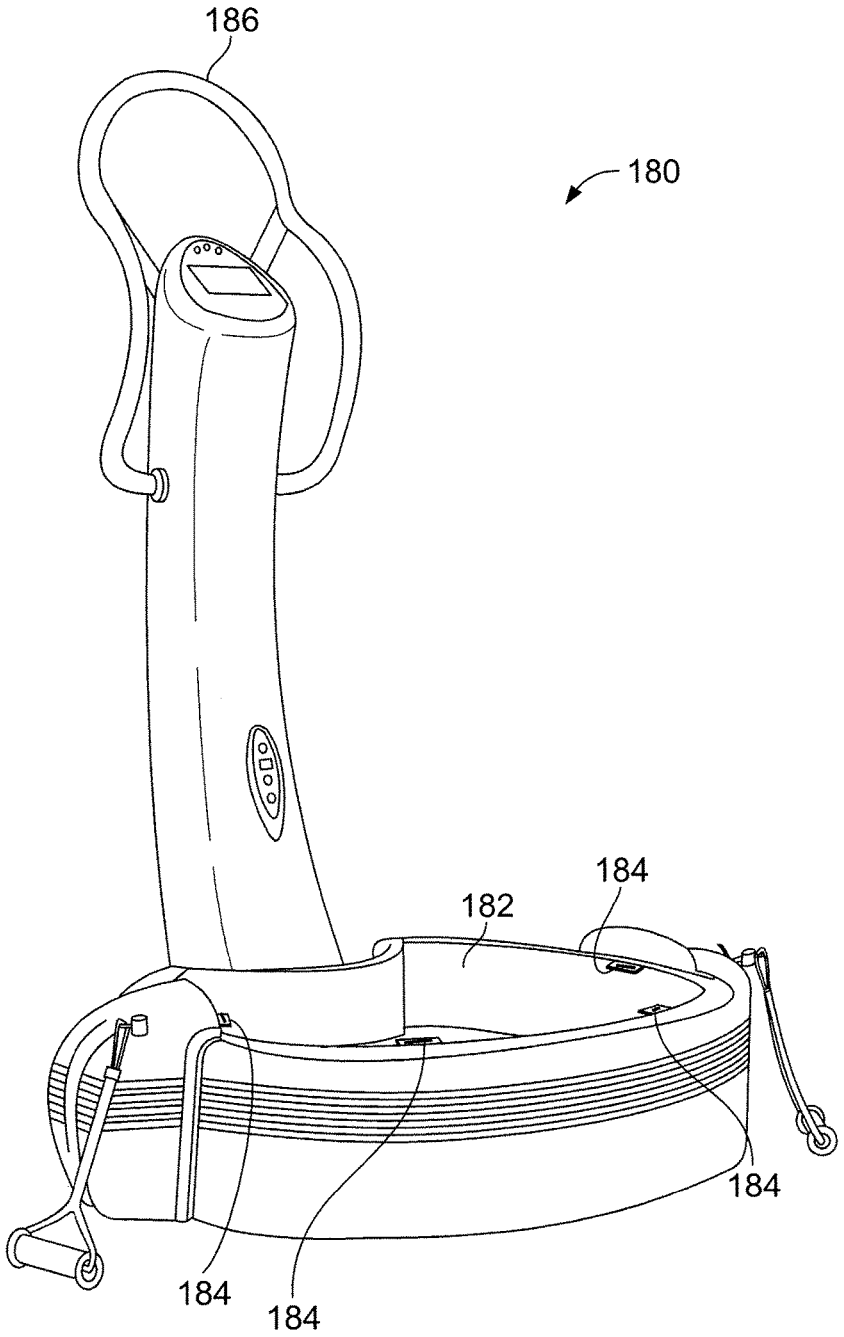
FIG. 4 is a perspective view of an exemplary whole body vibration (WBV) machine to which the upper body attachment of FIGS. 1A-1D may be attached.

With reference to FIG. 4, one exemplary WBV exercise machine 180, with which the attachment 100 is compatible, is shown as generally including a vibrating plate 182, receiving slots 184, and a stabilization handle 186. As described above, in one embodiment, the base of the attachment may be secured to the vibrating plate 182 by placing fasteners through the points of attachment on the base and into the receiving slots 184 in the vibrating plate 182. Once secured, vibrations in the vibrating plate will be imparted to the base and other portions of the attachment.

Still further, most existing WBV exercise machines, like that shown in FIG. 4, for example, include a stabilization handle near a user's chest. In one embodiment, the point of attachment of the upper diagonal support may be selectively attached to the stabilization handle 186 shown in FIG. 4. Securing the upper diagonal support to the stabilization handle 186 of the WBV exercise equipment helps prevent the attachment from swaying when in use. Moreover, the adjustment feature of the upper diagonal support may allow the length of the upper diagonal support to become shorter or longer. In the alternative, the adjustment feature may merely move the point of attachment in relation to the rest of the attachment. In any event, the adjustment feature allows the attachment to be compatible with a high percentage of existing WBV exercise machines.

As described above, the upper diagonal support may serve to prevent, or at least reduce, sway in the upper portion of the attachment. In some embodiments, though, the upper diagonal support must not inhibit vibrations that are intended to occur in the upper portion of the attachment. Thus, in some embodiments, the upper diagonal support must prevent sway and simultaneously allow for intended vibrations in the upper portion of the attachment. Put another way, the upper diagonal support must allow only for a limited range of movement in the upper portion of the attachment. While perhaps several design approaches could accomplish this need, one possible approach involves using a rubber bushing where the upper diagonal support is attached to the stabilization handle 186, where the upper diagonal support is attached to the crossbar, or at both locations. As for the type and number of bushings, design considerations may include the height of the crossbar above the vibrating plate 182 of the WBV exercise machine 180, the frequency at which the WBV exercise machine 180 operates, and the weight limit for users of the WBV exercise machine, for example.

In an alternative embodiment of the present disclosure, an accessory device or appliance can be connected or joined to a WBV machine, for example at the handles. When used in this manner, the WBV machine would not specifically convey vibration to the user's body. Instead, this alternative embodiment allows the user to position or configure the body, based upon advice or direction from a physician or technician, to take full advantage of the vibration form the WBV machine, while performing posture-reflection exercises using isometric means. This combination of the accessory device along with the WBV machine will increase substantially the effects of the WBV machine on postural muscles or accessory and supportive muscles and muscle groups. This advantage is obtained because all of the weight bearing muscles are incorporated simultaneously, thereby producing optimum recruitment of the neuro-musculoskeletal system.

The accessory or appliance device can also be attached directly to the attachment support frame of the present disclosure to provide for transmission of targeted vibration through the accessory device when the desired effect of the device is used as a fulcrum or pivot point, for example, for the cervical or lumbar spine, or when the objective is to address biomechanical compromise of the shoulder girdle, requiring a fulcrum about which rotation of the affected area (i.e., cervical, lumbar, shoulder or hip) during the performance of rehabilitative exercise.

In these instances, the transmission of vibration through the WBV machine through the accessory device provides additional stimulation of the affected tissues, while performing exercise training for the purposes of rehabilitation, reorientation and normalization of the biomechanics of the respective joint.

Figure 5:
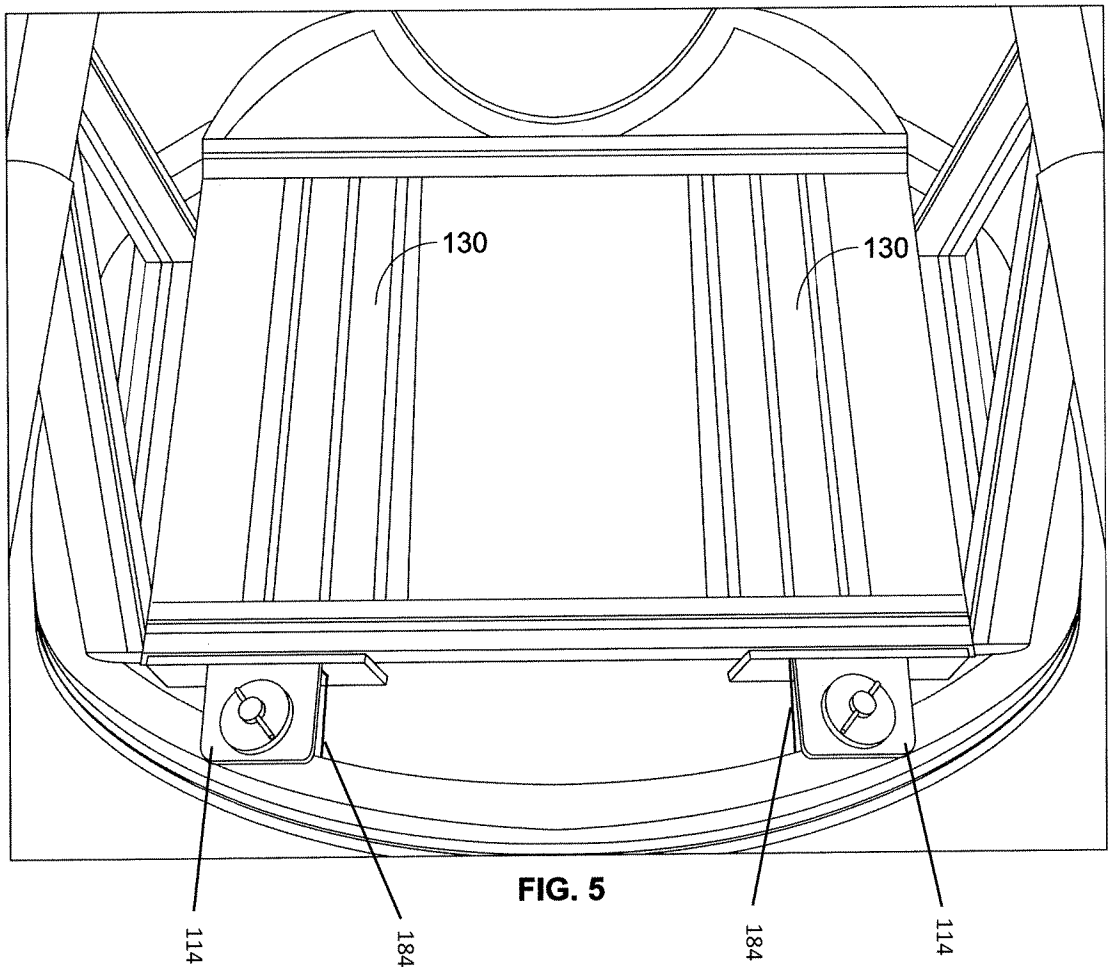
FIG. 5 is a top view of an alternative embodiment of the base of the upper body attachment.

In an alternative embodiment of the present invention as shown in FIG. 5, struts or frame foot members 130 are located on the base 102 of the attachment 100. The struts 130 can be made of any supportive material, such as metal, wood, plastic, etc. however, for the best performance, the struts 130 are made of the same material as the base 102. These struts 130 can be attached to the base 102 in a number of ways, however, to provide the most vibration, the struts 130 are attached to the base 102 using screws. The bottom of the struts 130 can be coated in a rubberized material or have pieces of rubber or foam attached thereto to reduce or eliminate noise due to vibration and also to reduce or eliminate scratching of the WBV exercise machine 180. Further, the entire base 102 of the attachment 100 can likewise be coated or have material attached thereto to protect the WBV exercise machine 180 from scratches and damage due to the weight of the attachment 100 when being placed on the WBV exercise machine 180 or moved into place.

Once the struts 130 are attached to the base 102, the base 102 contains two additional pieces that tie the base together for structural support. Further, when the user stands on the struts 130, the load generated by the user is placed on the base 102 of the attachment 100, and not on the WBV exercise machine 180. This additional strut or foot pieces 130 will further protect the WBV exercise machine 180 from heavy loads, since the attachment (through the struts 130 and the other supports described herein) is absorbing the entire (or almost entire) load.

Although numerous embodiments of this disclosure have been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the disclosed system and methods. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the disclosed system and methods as defined in the appended claims.

What is claimed is:

1. A vibration transfer attachment apparatus configured to be removably attached to a separate whole body vibration equipment thereby allowing the transfer of vibration to and through the attachment to targeted muscle groups involving the torso, upper extremities or the upper portions of the body, the vibration transfer attachment apparatus comprising:

a base, said base being configured to be removably attached to a separate whole body vibration equipment utilizing a plurality of points of attachment, said plurality of points of attachment located and positioned on said base to correspond to a plurality of receiving slots on said whole body vibration equipment, to affix the base to whole body vibration equipment, such that when affixed, said base is able to receive vibrations from said whole body vibration equipment and to transfer said vibrations;

a pair of uprights extending generally vertically from said base, each of said pair of uprights having a lower end and an upper end, said lower end being attached to said base in a manner that allows vibrations from said base to be transferred to and through said pair of uprights, said upper end of each of said pair of uprights being located at the opposite end of said lower end;

a crossbar, said crossbar affixed to each of the upper ends of the pair of uprights in a manner that allows vibrations from said pair of uprights to be transferred to and through said upper end and to and through said crossbar, thereby imparting stimulation to said targeted muscle groups; and an upper diagonal support, said upper diagonal support directly connecting said crossbar of said vibration transfer attachment apparatus to a stabilization handle of said separate whole body vibration equipment to reduce sway in the vibration transfer attachment apparatus.

2. The vibration transfer attachment apparatus of claim 1, further comprising at least two handles, said at least two handles slidably attached to each of said pair of uprights, wherein said at least two handles are slidably movable along said pair of uprights, and said pair of uprights allow vibrations from said pair of uprights to be transferred to said at least two handles.

3. The vibration transfer attachment apparatus of claim 2, wherein said at least two handles supporting a body weight of a user of the vibration transfer attachment apparatus.

4. The vibration transfer attachment apparatus of claim 3, further comprising a clamp and a fastener, said clamp and fastener located on each of said at least two handles, such that said at least two handles are slidably movable along said pair of uprights by using said fastener to release and tighten said clamp, and said pair of uprights allows vibrations from said uprights to be transferred to said at least two handles.

5. The vibration transfer attachment apparatus of claim 4, further comprising a first slotted track and a second slotted track, said first and second slotted tracks each located on one of said pair of uprights, such that said at least two handles are slidably movable along said pair of uprights by using said fastener to release and tighten said clamp received by said first and second slotted tracks.

6. The vibration transfer attachment apparatus of claim 1, further comprising a handlebar, said handlebar having a first end and a second end, said handlebar slidably attached to each of said pair of uprights, one of said pair of uprights at said first end and one of said pair of uprights at said second end, wherein said handlebar is slidably movable along said pair of uprights, and said pair of uprights allows vibrations from said pair of uprights to be transferred to said handlebar.

7. The vibration transfer attachment apparatus of claim 6, wherein said handlebar supports a body weight of a user of the vibration transfer attachment apparatus.

8. The vibration transfer attachment apparatus of claim 7, further comprising a first and second clamp and a first and second fastener, said first clamp and said first fastener located on said first end of said handlebar, and said second clamp and said second fastener located on said second end of said handlebar, such that said handlebar is attached to said pair of uprights, and said handlebar is slidably movable along said pair of uprights by using said first and second fastener to release and tighten said first and second clamp, respectively.

9. The vibration transfer attachment apparatus of claim 8, further comprising a first slotted track and a second slotted track, said first and second slotted tracks located on each of said pair of uprights, such that said first end of said handlebar and said second end of said handlebar is slidably movable along said pair of uprights by using said fastener to release and tighten said clamp received by said first slotted track and said second slotted track, respectively.

10. The vibration transfer attachment apparatus of claim 1, further comprising at least two struts, said at least two struts attached to said base, such that said at least two struts provide additional structural support for the base and allows a user of said vibration transfer attachment apparatus to stand on said struts and place some or all of said user's weight on said base and still receive vibrations transferred to and through said vibration transfer attachment apparatus.

11. A whole body vibration equipment machine, comprising:

a vibrating plate, said vibrating plate configured to impart vibrations;

plurality of receiving slots, said plurality of receiving slots positioned and located on said vibrating plate;

a stabilization handle; and a separate vibration transfer attachment apparatus configured to be removably attached to the vibrating plate thereby allowing the transfer of vibration to and through the separate vibration transfer attachment apparatus to targeted muscle groups involving the torso, upper extremities or the upper portions of the body, the separate vibration transfer attachment apparatus comprising:

a base, said base being configured to be removably attached to said vibrating plate utilizing a plurality of points of attachment, said plurality of points of attachment located and positioned on said base to correspond to said plurality of receiving slots on said vibrating plate, to affix the base to said vibrating plate, such that said base is able to receive vibrations from said vibrating plate and to transfer said vibrations;

a pair of uprights extending generally vertically from said base, each of said pair of uprights having a lower end and an upper end, said lower end being attached to said base in a manner that allows vibrations from said base to be transferred to and through said pair of uprights, said upper end of each of said pair of uprights being located at the opposite end of said lower end;

a crossbar, said crossbar affixed to each of the upper ends of the pair of uprights in a manner that allows vibrations from said pair of uprights to be transferred to and through said upper end and to and through said crossbar, thereby imparting stimulation to said targeted muscle groups; and an upper diagonal support, said upper diagonal support directly connecting said crossbar of said vibration transfer attachment apparatus to said stabilization handle to reduce sway in the vibration transfer attachment apparatus.

12. The vibration transfer attachment apparatus of claim 11, further comprising at least two handles, said at least two handles slidably attached to each of said pair of uprights, wherein said at least two handles are slidably movable along said pair of uprights, and said pair of uprights allow vibrations from said pair of uprights to be transferred to said at least two handles.

13. The vibration transfer attachment apparatus of claim 12, wherein said at least two handles supporting a body weight of a user of the vibration transfer attachment apparatus.

14. The vibration transfer attachment apparatus of claim 13, further comprising a clamp and a fastener, said clamp and fastener located on each of said at least two handles, such that said at least two handles are slidably movable along said pair of uprights by using said fastener to release and tighten said clamp, and said pair of uprights allows vibrations from said pair of uprights to be transferred to said at least two handles.

15. The vibration transfer attachment apparatus of claim 14, further comprising a first slotted track and a second slotted track, said first and second slotted tracks each located on one of said pair of uprights, such that said at least two handles are slidably movable along said pair of uprights by using said fastener to release and tighten said clamp received by said first and second slotted tracks.

16. The vibration transfer attachment apparatus of claim 11, further comprising a handlebar, said handlebar having a first end and a second end, said handlebar slidably attached to each of said pair of uprights, one of said pair of uprights at said first end and one of said pair of uprights at said second end, wherein said handlebar is slidably movable along said pair of uprights, and said pair of uprights allows vibrations from said pair of uprights to be transferred to said handlebar.

17. The vibration transfer attachment apparatus of claim 16, wherein said handlebar supports a body weight of a user of the vibration transfer attachment apparatus.

18. The vibration transfer attachment apparatus of claim 17, further comprising a first and second clamp and a first and second fastener, said first clamp and said first fastener located on said first end of said handlebar, and said second clamp and said second fastener located on said second end of said handlebar, such that said handlebar is attached to said pair of uprights, and said handlebar is slidably movable along said pair of uprights by using said first and second fastener to release and tighten said first and second clamp, respectively.

19. The vibration transfer attachment apparatus of claim 18, further comprising a first slotted track and a second slotted track, said first and second slotted tracks located on each of said pair of uprights, such that said first end of said handlebar and said second end of said handlebar is slidably movable along said pair of uprights by using said fastener to release and tighten said clamp received by said first slotted track and said second slotted track, respectively.

20. The vibration transfer attachment apparatus of claim 11, further comprising at least two struts, said at least two struts attached to said base, such that said at least two struts provide additional structural support for the base and allows a user of said vibration transfer attachment apparatus to stand on said struts and place some or all of said user's weight on said base and still receive vibrations transferred to and through said vibration transfer attachment apparatus.

* * * * *